United States Patent [19]

Hall

[11] Patent Number: 5,060,947

[45] Date of Patent: Oct. 29, 1991

[54] MAGNETIC PENDULUM RANDOM NUMBER SELECTOR

[76] Inventor: Guy E. Hall, 2490 N. 750 West, Harrisville, Utah 84414

[21] Appl. No.: 470,220

[22] Filed: Jan. 25, 1990

[51] Int. Cl.[5] ..... A63H 33/26

[52] U.S. Cl. ..... 273/138 A; 273/456; 446/238

[58] Field of Search ..... 273/1 M, 239, 138 A, 273/138 R, 142 JB, 143 C; 434/301, 330; 446/238

[56] References Cited

U.S. PATENT DOCUMENTS 3,478,466 11/1969 Conner ..... 273/1 M
4,011,674 3/1977 Jacobson ..... 273/1 M
4,250,659 2/1981 Ishiguro ..... 273/1 M
4,690,657 9/1987 Lodrick, Sr. ..... 273/1 M

*Primary Examiner*—Edward M. Coven
*Assistant Examiner*—Raleigh W. Chiu
*Attorney, Agent, or Firm*—A. Ray Osburn

[57] ABSTRACT

A magnetic pendulum random number selector having a symmetrical field of permanent magnets mounted in its base, along with a pendulum with a magnetized mass supported to swing through the fields of the magnets. The magnets are arranged symmetrically with respect to a vertical axis through the pendulum support point. The pendulum is manually set to swinging and comes to rest randomly at one of several locations above the assembly of magnets.

1 Claim, 2 Drawing Sheets

MAGNETIC PENDULUM RANDOM NUMBER SELECTOR

BACKGROUND OF THE INVENTION

1. Field

The field of the invention is devices for random selection from among an assemblage of individual numbers.

2. State of the Art

The random selection of numbers, or other objects, is the basis for many games of chance, the winner(s) being selected fully or partially upon this basis. Examples include dice games wherein dot inscribed cubes are tumbled in pairs, the total number of dots on the upwardly facing sides after each roll constituting randomly selected numbers. Often, the dice roll is the first of several subsequent steps in the game. Most card games involve random selection of cards dealt to each player, who must judge his chances based on his randomly selected "hand". Another device is the rotating wheel manually spun in roulette and similar games, and also large vertical wheels often used in television games. All of these prior art random number or location selectors serve their particular needs quite well. However, only the paired dies and the card decks are sufficiently portable and inexpensive for ordinarily home or private party use by individuals. The others are complicated, bulky and expensive. Constant use of dies becomes monotonous and boring. The number selection is complete in a fraction of a second, once the roll is made. There is no drawing out of the process to tease or tantalize the players, as with the roulette wheel, for example. Thus, there remains a need for random number or location selection devices for individual use, which extend the selection process for maximum suspense and entertainment.

BRIEF SUMMARY OF THE INVENTION

With the foregoing in mind, the present invention eliminates or substantially alleviates the shortcomings and disadvantages of prior art random number or position selection devices, by providing such a device based upon the operation of a pendulum with a mass of magnetic material set to swing through an assembly of individual magnetic fields symmetrically arranged with respect to locations, polarities, and strengths about a vertical axis through the pendulum oscillation point.

Each magnet of the group has an upwardly or downwardly facing North or South pole. Advantageously, magnets of two or more strengths, sizes, or both, may be used. The individual magnets may be spaced so that their fields are independent or interactive. Some magnets may be disposed with upward North poles and others with upward South poles. The result is a combined magnetic field with areas of dominant North or South polarity symmetrically arranged about the vertical axis. Preferably, the magnetic pendulum mass also comprises a permanent magnet. When the charged pendulum mass is set to swinging through the assembly of magnetic fields, it is variously attracted and repelled at different locations, and finally comes to rest unpredictably at one of the zones of attractive polarity under the influence of gravity, momentum, damping and magnetic attraction and repulsion forces. Preferably, the area directly below the pendulum support point is polarized to repel the polarized pendulum mass. Each capture zone may be provided with a visible number on the base of the apparatus, one of which is randomly selected with each use of the device.

Advantageously, the pendulum is affixed to the end of an elongate small diameter wire with its upper end formed into a coil spring which is secured to a cantilevered pendulum support structure. The spring provides a restoring and damping force to pendulum motion in addition to that of gravity when the pendulum mass is displaced and caused to swing.

It is therefore the principal object of the invention to provide an economical and intriguing method of random selection of numbers and locations, for use as an adjunct to games and the like, or directly as a source of amusement.

BRIEF DESCRIPTION OF THE DRAWINGS

In the drawings, which represent the best mode currently contemplated for carrying out the invention.

DETAILED DESCRIPTION OF ILLUSTRATED EMBODIMENTS

Figure 4:
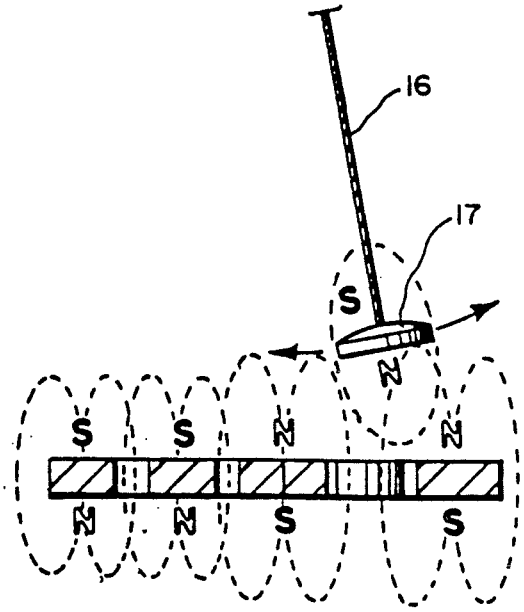

A magnetic random number selector 10 in accordance with the invention is illustrated in the drawings. A base 11, adapted to rest upon a horizontal planar surface, carries a pendulum support 12 with a cantilevered horizontal portion 13 having a down turned end 14 to which a pendulum assembly 15 is secured. Pendulum 15 comprises a wire shaft 16 carrying a pendulum mass 17. At its uppermost end, wire 16 is formed into a closed coil spring 18. Mass 17 comprises a permanently charged magnet, oriented "North" or "positive" pole downward and "South" or "negative" pole upward. (FIG. 4)

Figure 1:
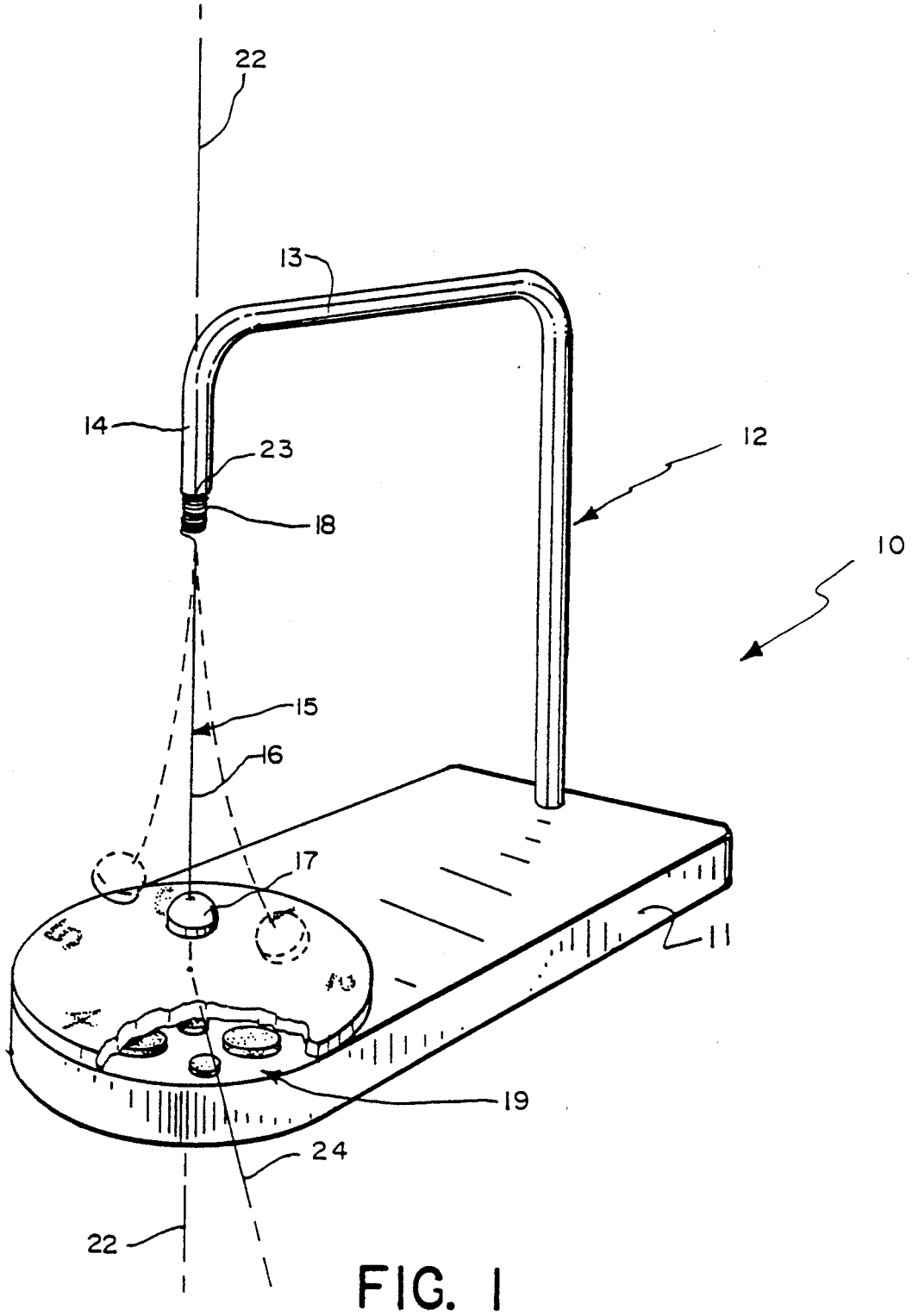
FIG. 1 is a perspective view of a magnetic pendulum random number selector in accordance with the invention, drawn to approximately full scale.
Figure 2:
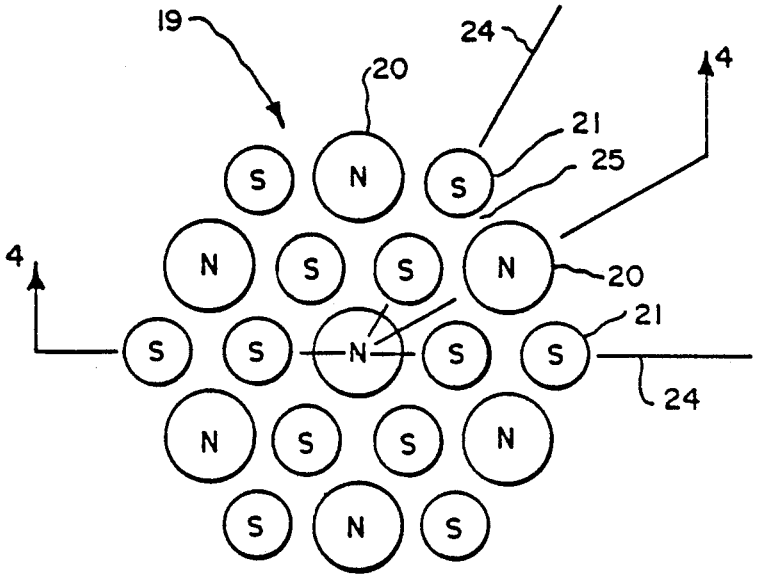
FIG. 2 is a schematic representation of a field of permanently charged magnets for use in accordance with the invention, drawn to approximately full scale, FIG. 3 a perspective view of one of the magnets of FIG. 2, drawn to approximately full scale, and FIG. 4 a schematic sectional view of the selector of FIG. 1, taken along line 4—4 of FIG. 2, drawn to approximately full scale.
Figure 3:
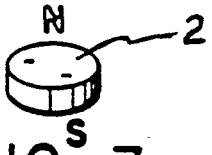

Base 11 has a group 19 of magnets including permanently charged larger magnets 20 and smaller magnets 21 arranged in a horizontal pattern symmetrical about a vertical axis 22 through shaft attachment point 23 on cantilever end 14. (FIGS. 1, 2 and 4) In the illustrated embodiment of random number selector 10, six of the larger magnets 20 are circularly arranged about axis 22 at 60° intervals. Another magnet 10 occupies the center of pattern 19. Two circles of six of the smaller magnets 21 complete the pattern 19. The small magnets of each circle are placed on radial lines 24 bisecting the 60° angles between the larger magnets 20. On each radial line 24 are two small magnets 21, one more distant from and one nearer to axis 22 than are the circularly arranged larger magnets 20. A minimum clearing distance 25 of $\frac{1}{8}$ inch is utilized in illustrative pattern 19.

North (N) poles of the larger magnets 20 face upwardly while South (S) poles of the smaller magnets 21 face upwardly. Magnetically charged pendulum mass 17, with its N pole downward, then is able to rest stably with shaft 16 deflected to place it over each of the twelve small magnets 21, and will come to rest in one of the twelve such positions when set to swinging over the pattern 19. (FIG. 4) However, since the small magnets 21 are of equal strength, as are the seven larger magnets 20, the areas of "capture" will not be randomly selected among the twelve locations. Rather, capture locations are in fact noticeably biased toward the magnets 21 closer to the center of magnet pattern 19, because of the closer approach of mass 17, and the smaller restoring forces from both gravity and spring 18 at these locations.

However, the point of rest will be randomly above one of the six radial lines 24 upon which the small magnets 21 are located, although biased in position therealong. Because of the repelling polarity of central large magnet 20, pendulum 15 is always prevented from coming to rest in a vertical, neutral position with shaft 16 vertically aligned with axis 22.

It could be argued that device 10 does not provide true random selection, because exact repetition of the starting swing of the pendulum would produce repeated selection of the same number. However, "exact" repetition of starting conditions is unattainable under any circumstances, and certainly is unattainable by manual initiation of the pendulum swing. In any event, it is believed that the system represented by device 10 is essentially chaotic, in that the tiniest change in initial conditions results in completely unpredictable end result number selection. The classic, perhaps facetious, analogy often referred to by practitioners of the science of chaos, that the air disturbance of a fluttering butterfly in Peking may materially affect the weather in New York City, may be expected to find an analogy in random number selection device 10.

Many variations may be made in illustrated random selector 10 without departing from the spirit of the invention. Other patterns of magnets may be employed in base 11, to provide differently located and/or more numerous pendulum capture zones. Compensation could be provided to reduce or eliminate the bias with distance from axis 22, such as providing the magnets in dished rather than in planar patterns to more nearly equalize the magnetic forces on the pendulum mass over the range of its swing. Compensating variations in magnet strength could also be utilized for this purpose (stronger magnets more distant from vertical axis 22), and reduction of magnetic pattern width to pendulum length ratio would reduce the magnitude of the bias, probably to unnoticeable levels. Wire shaft 16 with spring 18 provides gentle but positive restoring forces, so number selection is accomplished with a promptness designed to provide suspense while avoiding impatience. However, a universal pivot could be used instead of spring 18, or the entire shaft 16 could be of flexible cord or the like, perhaps with more prolonged and erratic pendulum action. At considerable more expense and complexity, electromagnetic coils or the like could be used to provide the magnetic fields, instead of the permanent magnets illustrated and described.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by U.S. Letters Patent is:

1. A random position selector, comprising:

an assembly of at least one pair of magnetic fields, the fields of each pair being horizontally spaced apart symmetrically about a common vertical axis and identical in shape, strength and polar orientation with respect to the common vertical axis; and a pendulum assembly and a support therefor, said assembly having an elongate vertical member and amass of magnetic material affixed at its lowermost end, said pendulum assembly being suspended to oscillate about a point on the common vertical axis of symmetry of the paired magnetic fields with said mass within the assembly of magnetic fields, so that the pendulum, when set to swinging freely, will, under the influences of damping forces, gravity and the magnetic fields, come to rest with the mass randomly in one of at least two positions; wherein the pendulum mass as a magnetic field, and said assembly includes at least two pairs of fields, the orientation of the fields of at least one pair of which is opposite to that of at least one of the remaining pairs in the assembly; wherein the orientation of at least one of the pairs of fields in the magnetic field assembly is substantially vertical and the orientation of the field of the pendulum mass is substantially vertical, wherein the random position selector further comprises means significantly damping the swinging of the mass to accelerate its coming to rest in randomly selected position; wherein the elongate vertical member of the pendulum assembly comprises an elongate stiff portion carrying the pendulum mass at its lowermost end and a flexible damping portion joining the stiff portion to the pendulum support; wherein the stiff portion is of wire; and the damping portion comprises a wire coil spring.

* * * * *